US010350559B2

(12) United States Patent
Hielscher et al.

(10) Patent No.: US 10,350,559 B2
(45) Date of Patent: Jul. 16, 2019

(54) APPARATUS AND METHOD FOR TREATING FLUIDS WITH ULTRASOUND

(71) Applicant: Dr. Hielscher GmbH, Teltow (DE)

(72) Inventors: Thomas Hielscher, Potsdam (DE); Harald Hielscher, Stahnsdorf (DE); Holger Hielscher, Teltow (DE)

(73) Assignee: Dr. Hielscher GmbH, Teltow (DE)

( * ) Notice: Subject to any disclaimer, the term of this patent is extended or adjusted under 35 U.S.C. 154(b) by 1050 days.

(21) Appl. No.: 14/481,040

(22) Filed: Sep. 9, 2014

(65) Prior Publication Data

US 2015/0071023 A1 Mar. 12, 2015

Related U.S. Application Data

(60) Provisional application No. 61/875,292, filed on Sep. 9, 2013.

(30) Foreign Application Priority Data

Aug. 12, 2014 (DE) ..... 10 2014 111 470

(51) Int. Cl.

| | |
|---|---|
| ***B01F 11/00*** | (2006.01) |
| ***B01F 11/02*** | (2006.01) |
| ***B01F 15/02*** | (2006.01) |
| ***B01F 3/08*** | (2006.01) |

(52) U.S. Cl.
CPC ..... *B01F 11/0258* (2013.01); *B01F 3/0819* (2013.01); *B01F 15/0201* (2013.01)

(58) Field of Classification Search
CPC .... B01F 11/0258; B01F 11/02; B01F 3/0819; B01F 15/0201
See application file for complete search history.

(56) References Cited

U.S. PATENT DOCUMENTS

| | | | | |
|---|---|---|---|---|
| 3,202,281 A * | 8/1965 | Weston | B01J 19/10 209/164 |
| 4,117,550 A * | 9/1978 | Folland | B01F 3/088 366/136 |
| 4,175,873 A * | 11/1979 | Iwako | B01F 5/26 366/165.3 |
| 4,848,916 A * | 7/1989 | Mead | A61M 1/1656 366/137 |
| 2009/0168591 A1* | 7/2009 | Wenzel | B01F 3/1242 366/116 |

* cited by examiner

*Primary Examiner* — Anshu Bhatia
(74) *Attorney, Agent, or Firm* — Ewers & Hasselmann PLLC

(57) ABSTRACT

An apparatus and a method for treating fluids with ultrasound are provided. In order to achieve a desired effect of the treatment as efficiently as possible, the apparatus has a plurality of inlet openings for the fluids and the fluids to be brought into contact with one another while being exposed to ultrasound.

6 Claims, 2 Drawing Sheets

APPARATUS AND METHOD FOR TREATING FLUIDS WITH ULTRASOUND

CROSS REFERENCE TO RELATED APPLICATIONS

This application claims priority to German Application No. DE 102014111470.1, filed on Aug. 12, 2014, and also claims benefit of U.S. Provisional Application No. 61/875,292, filed on Sep. 9, 2013, the entire contents of which are hereby incorporated by reference.

TECHNICAL FIELD

The disclosure relates to an apparatus for treating fluids with ultrasound, with a container for receiving the fluid, and with an ultrasonic emitter which is arranged in the container and is configured to emit during operation of the apparatus ultrasound to the fluids contained in the container. The disclosure further relates to a method for treating fluids with ultrasound.

BACKGROUND

Apparatuses and methods for treating fluids with ultrasound are generally known. Frequently, the fluids are to be mixed together to produce, for example, emulsions or dispersions, to cause precipitation reactions or to perform sonochemical reactions. In conventional apparatuses and methods, two different fluids are mixed together for this purpose and then treated by ultrasound. Due to rapidly occurring reactions between the two fluids, the subsequent ultrasonic treatment of the fluid mixture is frequently unable to produce the desired mixing or reaction effect, since the ultrasound treatment starts too late.

SUMMARY

It is thus an object of the invention to provide an apparatus and a method for treating fluids, with which a desired reaction between the fluids can be generated with improved reaction quality.

The object is solved with the above-mentioned apparatus in that the apparatus has a plurality of inlet openings for introducing at least two different fluids. The object is solved with the aforementioned method in that at least two different fluids are to be brought into contact with each other under the action of ultrasound.

There is no time delay between the mixing and the ultrasonic treatment because the fluids are mixed in the vessel in which the ultrasonic emitter is arranged and treated with ultrasound while they intermix, so that the reactions between the fluids take place directly while exposed to ultrasound, and are thus influenced as desired. The fluids can thus be brought into contact with each other at the same time while being sonicated with ultrasound.

According to an aspect of an exemplary embodiment, the apparatus may have two, three or more than three inlet openings. If only two or three inlet openings are provided, this can already provide a good spatial distribution or mixing of the fluids introduced into the vessel through the inlet openings. The use of four or more inlet openings further improves the spatial arrangement of the fluids injected into the container so that these are uniformly mixed, once they exit from the inlet openings and enter the container.

When a plurality, for example two fluids are mixed with each other in the vessel, then one of the fluids may enter the container through one of the openings and the other of the fluids may enter the container through another opening arranged adjacent to the one opening. When more than two openings and in particular more than three or even more than four openings are provided, for example two fluids can be alternately introduced into the container through the openings.

Between two and 1000 openings may be provided. For example, between three and 50, and in particular ten or 48 openings may be provided so as to be able to fill the spatial distribution of the fluids into the container with a reasonable effort as uniformly as possible or with the required distribution.

Furthermore, the container may have at least one outlet opening for discharging the fluid mixture from the container. The fluid mixture may also include or may be a reaction product of the two fluids. Up to 1000, between one and 10, and in particular two outlet openings may be provided.

At least one of the openings may have an opening cross-section with an area between 0.001 and 20,000 $mm^2$, in particular between 0.01 and 1000 $mm^2$, and for example, 100 $mm^2$. A minimum distance between two adjacent ones of the apertures may be between 0.1 and 100 mm, in particular the distance may be between 0.5 and 10 mm and may be, for example, 1 mm.

At least one of the inlet openings may be partially or completely arranged inside another one of the inlet openings. In particular, at least two of the inlet openings may be constructed or arranged concentrically with respect to each other. One of the fluids may flow into the container through the innermost of the inlet openings, while another of the fluids may flow into the container through the remaining, for example, at least partly or completely sickle-shaped or circular outermost of the inlet openings, so that the fluids come in direct contact with each other immediately after exiting the concentric inlet apertures. If more than two fluids are to be treated in the vessel, an additional annular inlet opening arranged concentric with respect to the other inlet openings and surrounding the other inlet openings may be provided for each of the other fluids.

At least one of the inlet openings may be arranged inside the container so as to allow the fluid to exit the inlet opening as close as possible from the ultrasonic emitter, thereby further improving sonication with ultrasound. An inlet opening arranged inside the container is spaced from a side wall and/or a floor or a lid of the container.

The at least one inlet opening arranged in the container may be an opening of a hollow profile protruding into the container, for example a tube. When a plurality of inlet openings are located inside the container, each of the inlet openings arranged inside the container may be an opening of a corresponding hollow profile extending into the container. The hollow profile may have more than one opening arranged in the container, wherein this opening will be referred to only as an inlet opening to simplify the description of the disclosure. For example, when four inlet openings are provided, these may be arranged in form of four hollow sections inside the container.

The at least one inlet opening arranged in the container may during the operation of the apparatus be arranged in a cavitation zone of the container. Furthermore, two, several or the entire inlet openings may during the operation of the apparatus be arranged in the cavitation zone of the container. Cavitation is generated during operation of the apparatus in the cavitation zone, preferably by ultrasound. An inlet opening arranged in the cavitation zone of the container during operation of the apparatus exhibits changes in a surface of a structure defining the inlet opening caused by cavitation, for example the hollow profile. Sonication in the cavitation field is particularly intense, so that the reaction between the fluids can be particularly efficiently influenced by the cavitation.

The fluids may be introduced into a cavitating mixture of the fluids or into a cavitating fluid, which may be one of the fluids or another fluid, so as to further improve the intermixing and/or the reaction of the fluids with each other.

To allow greater flexibility in the treatment of various fluids, the hollow sections may be displaceable along their longitudinal axis so that the openings of the hollow profiles can be arranged at different positions inside the container. In particular, the hollow sections may be protrude into the vessel, or be for example attached to the vessel, and be movable along their longitudinal axis.

According to another aspect of an exemplary embodiment, the ultrasonic emitter may be an ultrasonic generator or may be connected to an optionally provided ultrasonic generator of the apparatus for transmitting ultrasound, wherein the ultrasonic generator generates ultrasound preferably piezo-electrically, inductively or magneto-restrictively. Preferably, the ultrasonic generator is an ultrasonic generator that generates ultrasound piezo-electrically.

An internal volume of the container may be between one and 1,000,000 $cm^3$. In particular, the internal volume may be between 10 and 5000 $cm^3$. For example, the internal volume is 250 $cm^3$.

The apparatus may be configured to treat the fluids at an internal pressure inside the container from zero bar to 500 bar. Zero bar hereby corresponds to a vacuum. In particular, the internal pressure may be between 1.1 bar and 100 bar and may be, for example, five bar. The container may be made from a material that includes a hard material such as metal, glass, ceramic or plastic, or may be composed of such a material or a mixture of such materials. Preferably, the container is manufactured from a metal or at least a metal alloy, such as stainless steel.

The apparatus may have at least one energy source suitable for producing cavitation in the interior space of the reactor, wherein the energy source is or includes, for example, an ultrasonic source, which may be connected to the ultrasonic generator for power transmission. Preferably, one or two energy sources may be provided, wherein one of them or both may be an ultrasonic source.

The openings may be arranged so that they face each other or are at least placed in opposing directions.

The apparatus may have at least one additional energy source. The at least one additional energy source may be a heating or cooling system for the fluid mixture arranged in the vessel. Furthermore, the at least one energy source may be a radiation source configured to emit radioactive radiation into the container. The additional energy source may also be a radiation source emitting infrared, ultraviolet and/or visible light into the container. Furthermore, the radiation source may be configured to deliver x-ray radiation into the container. The energy source may also be capable of emitting high frequency radiation, for example microwaves or radio waves, into the container. In addition, the energy source may cause high pressure intervals or mechanical agitation, thereby influencing the fluid mixture disposed in the container. The energy source may also provide electrical power, both direct current and alternating current.

At least one static element may be arranged in the container. The static element may include or consist of steel wool, a catalyst, beads or particles, fabrics, tubular elements and/or hose elements.

The apparatus may include at least one or more control valves arranged on at least one of the inlet openings for regulating of the pressure and/or flow rate of the fluid flowing into the container.

Moreover, at least one pump or an extruder in communication with one of the inlet openings or the at least one outflow opening may be provided.

The apparatus may be configured to pass a fluid and, for example, the fluid mixture several times through the container. If the fluid or the fluid mixture is recirculated through the vessel, it can be treated with ultrasound multiple times. Additionally or alternatively, fluid can be added to the fluid or the fluid mixture multiple times.

The container may be designed so that a standing ultrasonic wave is formed in the fluid mixture or that a resonant length $n \cdot \lambda$ (lambda)/2 is present between the ultrasonic source and a container wall. The standing wave has a stationary maximum, so that the cavitation zone is located in the container at a defined location.

The entire volume of fluids passing through the container during the operation of the apparatus may have a flow rate between one and 100,000 ml/min. In particular, the flow rate may be between 10 and 10,000 ml/min, for example 500 ml/min.

The apparatus may be configured such that during the operation fluids with a flow rate of between one and 100,000 ml/min can pass through. The flow rate may be, for example, between 10 and 10,000 ml/min and about 500 ml/min.

Moreover, the apparatus may be configured to allow the fluids to flow into the container with identical or different volume flow rates. The apparatus may also be configured to treat fluids with identical or different viscosity. Fluids having identical or different pH values may also enter through the inlet openings and be treated with the apparatus. The fluids treatable with the apparatus may be fully, partly or hardly miscible with each other.

Furthermore, the apparatus may be configured to treat the fluids at temperatures between zero and 2,000 K, in particular between 270 and 1500 K and for example at 293 K.

The method according to the exemplary embodiment may be further improved in accordance with aspects of additional exemplary embodiments, which may be beneficial severally and which, unless otherwise stated, may be combined in any suitable manner, which will be discussed in further detail below:

According to a further aspect of an exemplary embodiment, the fluids may be treated at a pressure between 0 and 500 bar. 0 bar corresponds to a pressure in a vacuum. In particular, the pressure may be between 1.1 and 100 bar and, for example, 5 bar.

The fluids may be brought into contact while flowing in opposite directions so as to allow a particularly good intermixing of the fluids.

With the method according to the disclosure, fluids having identical or different volumes, identical or different viscosity and/or identical or different pH values may be treated. Moreover, the fluids treatable with the method may be miscible with each other completely, partially or only with difficulty.

Between two and 1000 fluids may be mixed together and treated with ultrasound, wherein the at least two fluids may be different. In particular, between two and fifty and, for example, exactly two different fluids may be treated.

At least one of the fluids may be a liquid or a melt. For example, the fluid may include or be an acid, a base, an oil, a triglyceride, a solvent, a catalyst, a polymer, a metal, a salt, a gas, a dispersion, a suspension, an emulsion, a stabilizer, a dispersing additive, a solution, a gel or a supercritical fluid, a monomer, a binder, a liquid crystal, an amorphous metal alloy (so-called metallic glass) or a glass. Other fluids to be treated may each also include or be a material composed of the aforementioned materials.

The fluids may be treated at temperatures between zero and 2,000 K, in particular between 70 and 1500 K and for example at 293 K.

Preferably, the fluids are fed into one another and/or to a cavitating fluid mixture, or a cavitating fluid, such as the cavitation zone, which may be located inside the container.

At least one of the fluids may be supplied to the other fluid or the fluid mixture and in particular introduced into the container at an inlet velocity of between one and 100,000 mm/sec, in particular between five and 1.000 mm/sec and, for example, 50 mm/sec.

With the method, at least one property of at least one of the fluids to be treated may be influenced, processed or changed.

Preferably, the fluids are intermixed so that they can react with each other. At least two of the supplied fluids may react with each other or be intermixed to produce micro-scale or nano-scale emulsions or dispersions. Moreover, chemical or biological processes or chemical reactions, such as sono-chemical reactions, between the fluids may be produced with the method.

The apparatus and/or the method may be used in at least one of the processes listed below, in particular chemical processes:

Production of emulsions or dispersions having an average particle diameter of between one and 1,000,000 nm, in particular between five and 100,000 nm and, for example, 1000 nm, chemical reactions or processes, such as precipitation reactions, phase transfer reactions, catalysis, phase transfer catalysis, oxidation, reduction, trans-esterification or esterification, melting, or solidification, crystallization, sol-gel reaction, polymerization, or hydrolysis, or modification of at least one property, such as chemical composition, particle size, droplet size, temperature, gas content, or solvent processes, phase transfer extraction or extraction. The method and/or the apparatus may be used in particular for precipitation reactions or for the preparation of emulsions.

BRIEF DESCRIPTION OF THE DRAWINGS

Exemplary embodiments will now be described with reference to the drawings. The different features of the exemplary embodiments may be combined independent of one another, as has already been stated for the individual advantageous embodiments.

DESCRIPTION OF EXEMPLARY EMBODIMENTS

First, the structure and function of an apparatus according to an exemplary embodiment are described with reference to the exemplary embodiment shown in FIG. 1.

Figure 1:
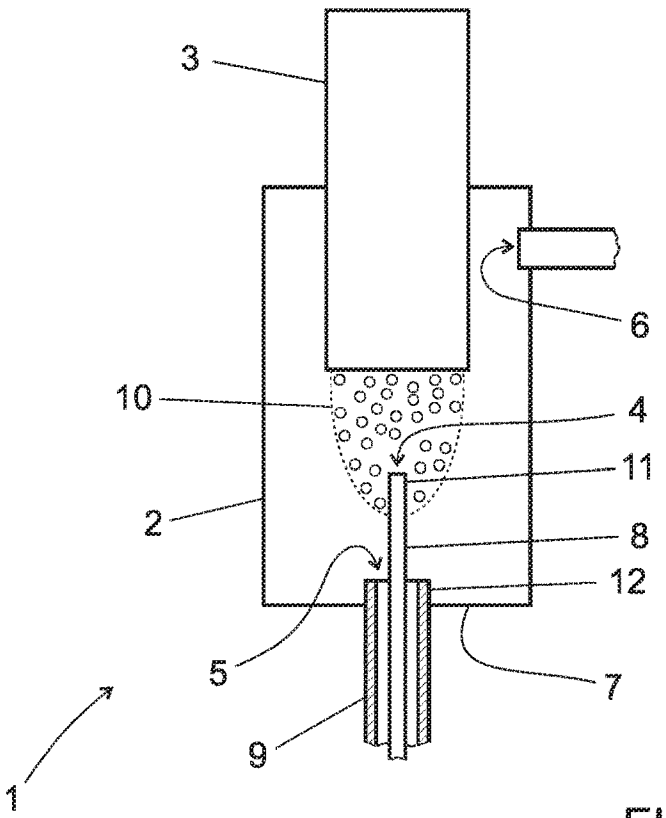
FIG. 1 is a block diagram of an apparatus for treating fluids with ultrasound according to an exemplary embodiment.

FIG. 1 shows the apparatus 1 for the treatment of fluids with ultrasound with a container 2, into which the fluids can be introduced for the treatment. The container 2 can also be referred to as a reactor, and may be an open container. However, the container 2 shown in the exemplary embodiment of FIG. 1 is a closed container. In a container 2 designed as a closed container, the fluids can be treated at an internal pressure in the container 2 that is different from ambient pressure.

Furthermore, the apparatus 1 is illustrated as having an ultrasonic emitter 3, which is at least partially arranged in the container 2 and in particular protrudes into the container 2. The ultrasonic emitter 3 is formed so as to be able to emit ultrasound into the fluids disposed in the container 2 during the operation of the apparatus 1.

Moreover, the apparatus 1 has two inlet openings 4, 5, though which fluids can flow into the container 2. The fluids that entered the container 2 through the inlet openings 4, 5 are able to exit the container 2 again through an outlet opening 6.

The inlet openings 4, 5 may be openings arranged in the walls and, for example, in an upper wall 7 which may be a lid or a base of the container 2. However, in the exemplary embodiment of FIG. 1, the inlet openings 4, 5 are openings of hollow bodies 8, 9. The hollow bodies 8, 9 are embodied by way of example as tubes protruding into the container 2 and opening into the interior of the container 2.

At least the inlet opening 4 formed by the hollow body 8 protrudes in the exemplary embodiment of FIG. 1 into a cavitation zone 10, which is formed in the fluid mixture disposed in the container 2 during the operation of the apparatus 1. The inlet opening 5 formed in the container 2 by the hollow body 9 is spaced from the cavitation zone 10. Alternatively, the inlet opening 5 may also be arranged in the cavitation zone 10. An inlet opening 4, 5 that is arranged in the cavitation zone 10 can be easily identified following the operation of the apparatus 1 because a structure forming the inlet opening 4, 5, for example the hollow body 8, 9, is superficially damaged by the cavitation.

In the exemplary embodiment of FIG. 1, the hollow bodies 8, 9 are concentrically arranged so that the hollow body 8 extends through the hollow body 9 into the container 2. Free ends 11, 12 of the hollow body 8, 9 arranged in the container 2 have a mutual spacing along the longitudinal direction. Alternatively, the free ends 11, 12 may also be arranged in the container 2 at the same height along the longitudinal direction of the hollow bodies 8, 9. In particular, the hollow bodies 8, 9 can protrude into the container 2 and can be movable in their longitudinal direction, so that depending on the desired treatment of the fluids, one or both of the inlet openings 4, 5 may be arranged inside or outside the cavitation zone 10.

Figure 2:
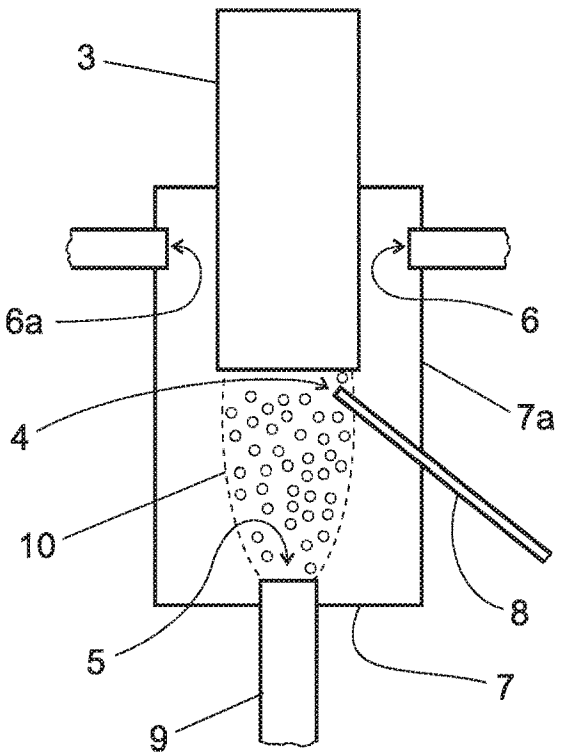
FIG. 2 is a block diagram of the apparatus according to another exemplary embodiment.

FIG. 2 schematically shows the apparatus 1 according to another exemplary embodiment. Elements corresponding in function and/or structure to the elements of the exemplary embodiment of FIG. 1 are denoted with the same reference symbols. For sake of brevity, only the differences to the exemplary embodiment of FIG. 1 will be discussed below.

In the exemplary embodiment of FIG. 2, both inlet openings 4, 5 are arranged in the cavitation zone 10, wherein the inlet opening 4 is located closer to the ultrasonic emitter 3 than the inlet opening 5. Furthermore, the inlet opening 5 is arranged in a region of the cavitation zone 10 that is most distal from the ultrasonic emitter 3.

The arrangement of the inlet opening 5 in the exemplary embodiment of FIG. 2 corresponds essentially to the arrangement of the inlet opening 5 of the exemplary embodiment of FIG. 1. However, the inlet opening 4 in the exemplary embodiment of FIG. 2 is positioned differently from the exemplary embodiment of FIG. 1. A fluid flowing into the container 2 through the inlet opening 5 has velocity vectors that are directed almost completely toward the ultrasonic emitter 3. However, components of the velocity vectors of the fluid flowing into the container 2 through the inlet opening 4 are oriented transversely to the ultrasonic emitter 3.

To be able to arrange the inlet opening 4 like in the exemplary embodiment of FIG. 2, the hollow body 8 may enter the container 2 through a wall 7*a* of the container 2 that is adjacent to the wall 7. A fluid mixture, which exits from the container 2 through the outlet opening 6, can flow through the wall 7*a*. The wall 7*a* may be a side wall of the container. Another outlet opening 6*a* my additionally be provide, that may allow the fluid mixture to exit from the container 2 through a wall opposite the wall 7*a*.

Figure 3:
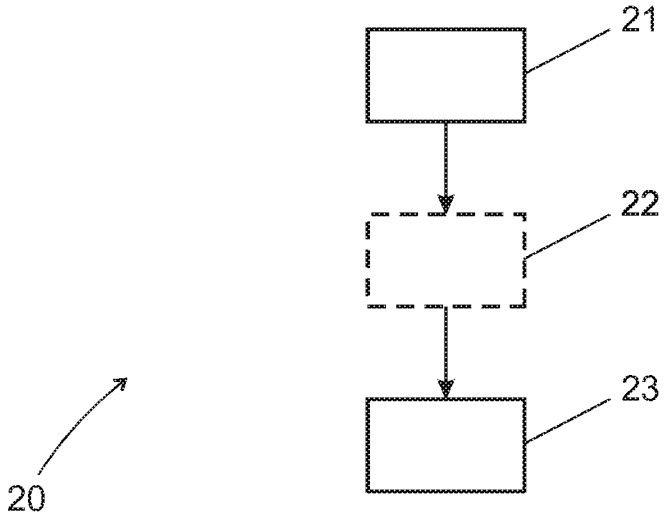
FIG. 3 is a flow chart of a method for treating fluids with ultrasound according to a further exemplary embodiment.

FIG. 3 shows a flow chart of a method according to an exemplary embodiment. The same reference symbols are used for elements of the exemplary embodiments of FIGS. 1 and 2, which will used below to illustrate the method.

The exemplary method 20 illustrated in FIG. 3 begins with a first step 21. For example, the apparatus 1 may be started at step 21.

In an optional step 22, a process region provided in the container 2 in which the fluids are to be treated can be filled with one of the fluids or with the fluids or with another fluid. In particular, the process region may be located inside the container 2 so that the ultrasonic emitter 3 is completely covered with the fluid or the fluid mixture. The process region may also take up the entire volume of the container 2. When the process region is sufficiently and, for example, completely filled, the fluid mixture can flow through the container 2 and in particular drain from the at least one outlet opening 6, whereby fluids can be continuously replenished through the inlet openings 4, 5. As soon as a sufficient quantity of the fluids is disposed inside the container 2, the ultrasonic emitter 3 may sonicate this fluid mixture with ultrasound.

In the following method step 23, the at least two fluids are brought into contact with one another and thereby intermixed while applying ultrasound. In particular, the fluids may be intermixed through the action of ultrasound-induced cavitation. This makes it possible to achieve the desired high-quality treatment of the fluids.

What is claimed is:

1. An apparatus for treating fluids with ultrasound comprising:

a container to receive the fluids;

an ultrasonic emitter which is arranged in the container and which is configured to emit ultrasound to the fluids contained in the container during an operation of the apparatus; and a plurality of inlet openings to introduce at least two different fluids into the container, wherein at least one of the inlet openings is arranged inside the container, wherein the at least one inlet opening arranged inside the container is arranged in a cavitation zone of the container during the operation of the apparatus, wherein a fluid flowing into the container through the at least one inlet opening arranged in the cavitation zone has velocity vectors that are directed almost completely toward the ultrasonic emitter, and wherein components of the velocity vectors of the fluid flowing into the container through the at least one inlet opening arranged in the cavitation zone are oriented transversely to the ultrasonic emitter.

2. The apparatus according to claim 1, further comprising at least three inlet openings.

3. The apparatus according to claim 1, wherein at least one of the inlet openings is arranged inside another one of the inlet openings.

4. The apparatus according to claim 1, wherein at least two of the inlet openings are arranged substantially concentrically in relation to each other.

5. The apparatus according to claim 1, wherein the at least one inlet opening arranged in the container is an opening of a hollow profile protruding into the container.

6. The apparatus according to claim 1, wherein the ultrasonic emitter is configured to emit the ultrasound to the fluids contained in the container to generate cavitation in the fluids in the cavitation zone.

* * * * *